US006226811B1

(12) United States Patent
Fagan

(10) Patent No.: US 6,226,811 B1
(45) Date of Patent: May 8, 2001

(54) EPIDERMAL SCRUBBING DEVICE

(76) Inventor: Edwin W. Fagan, 20051 Kelly Rd., Detroit, MI (US) 48225

( * ) Notice: Subject to any disclaimer, the term of this patent is extended or adjusted under 35 U.S.C. 154(b) by 0 days.

(21) Appl. No.: 09/434,639

(22) Filed: Nov. 5, 1999

(51) Int. Cl.[7] ..... A47K 7/02
(52) U.S. Cl. ..... 4/606; 15/207.2; 15/DIG. 5
(58) Field of Search ..... 4/606, 581, 582–583; 15/207.2, DIG. 5; 601/27, 28

(56) References Cited

U.S. PATENT DOCUMENTS

| | | | | |
|---|---|---|---|---|
| 3,577,985 | | 5/1971 | Guffin | 4/606 X |
| 3,750,226 | * | 8/1973 | Morgan | 4/606 X |
| 5,175,896 | * | 1/1993 | Zamir | 4/606 |
| 5,277,389 | | 1/1994 | Ballares et al. | 4/606 X |
| 5,450,647 | | 9/1995 | Dorsey | 4/606 X |
| 5,517,705 | | 5/1996 | Jackson | 4/606 |
| 5,588,160 | | 12/1996 | Nichols | 4/606 |
| 5,729,858 | | 3/1998 | Riffel | 4/606 X |
| 5,774,907 | | 7/1998 | Doggwiler | 4/606 |
| 5,784,722 | | 7/1998 | Ureta et al. | 4/606 X |

* cited by examiner

*Primary Examiner*—Steven O. Douglas
*Assistant Examiner*—Kathleen J. Prunner
(74) *Attorney, Agent, or Firm*—Young & Basile, P.C.

(57) ABSTRACT

An epidermal scrubbing device intended for use by human beings comprising a rigid plastic base having integral suction cups for attachment to a shower wall. Insert molded into the base is a polypropylene plastic scrubbing surface characterized by a two-dimensional array of soft, smooth surfaced, plastic nubs having a height on the order of ½ of an inch. Where desired, a column of slightly higher nubs may be added for scrubbing, for example, the spinal area.

1 Claim, 1 Drawing Sheet

EPIDERMAL SCRUBBING DEVICE

FIELD OF THE INVENTION

This invention relates to epidermal cleaning and massaging devices of the type comprising a rigid base which may be attached such as by suction cups to the wall or floor of a shower wherein the device is further provided with a scrubbing contact surface which affords safe, comfortable, and effective scrubbing of body parts such as the back and feet.

BACKGROUND OF THE INVENTION

The prior art includes numerous devices intended for use in a shower to scrub and clean a user's back. One such device is described in U.S. Pat. No. 5,277,389 to Ballares et al. comprises a sponge releasably attached to a holder which, in turn, is mounted by suction cups on a shower wall or floor. Other devices exhibit long soft bristles which are slow to dry and can breed mildew. Other devices are adapted to receive plumbing whereby a stream of water may be caused to emanate from and/or through the scrubbing surface; see, for example, U.S. Pat. No. 5,774,907 to Doggwiler.

SUMMARY OF THE INVENTION

It is the principal objective of this invention to provide an improved scrubbing device of the type and class described above but in which the structure providing the scrubbing surface is essentially integral with a rigid base, is constructed so as to be essentially permanent in nature and is detailed in such a way so as to provide a safe, comfortable, stimulating, and effective epidermal scrubbing action in a showering or bathing environment.

In general, this is objective is achieved through the provision of a relatively rigid base, typically plastic such as polyethylene or polypropylene, and further providing an essentially integral scrubbing surface device characterized by a two-dimensional array of spaced soft plastic and smooth surfaced, nub-like protrusions of a uniform height on the order of ⅛ to ⅜ of an inch. The nub-like protrusions preferably have a height-to-width ratio of between approximately 1:1 and 3:1 and are spaced apart so as to provide a density of between 4 and 16 nub-like protrusions per square inch.

In the preferred embodiment, these nub-like protrusions are supplemented by one or more columns or rows of slightly larger and higher protrusions so as to provide a more effective scrubbing and/or stimulating action for certain parts of the body such as the center of the back or the feet.

The device of the present invention is effective both with and without soap and with suction cups on the rear surface thereof, may be configured variously to suit both functional and aesthetic objectives. It requires no periodic replacement of inserts and is readily cleaned and disinfected.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWING

The description herein makes reference to the accompanying drawings wherein like reference numerals refer to like parts throughout the several views, and wherein.

DESCRIPTION OF THE PREFERRED ILLUSTRATIVE EMBODIMENT

Figure 1:
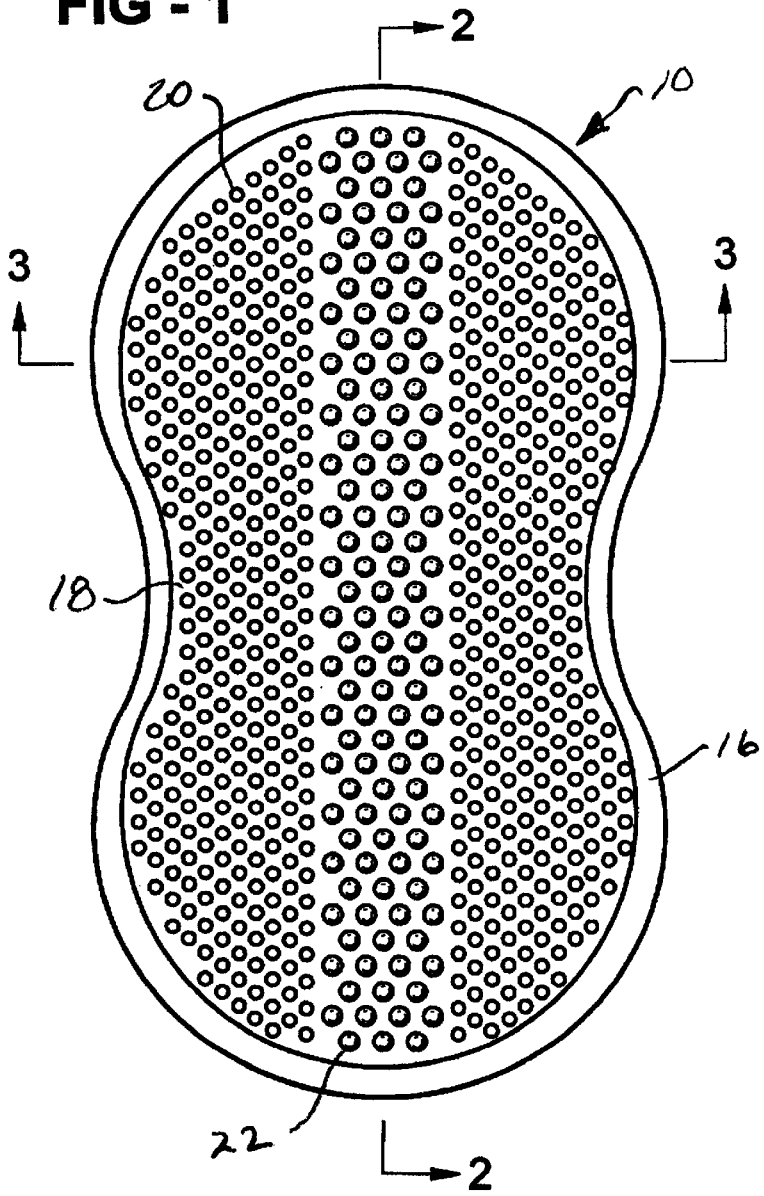
FIG. 1 is a perspective view of an epidermal scrubbing device embodying the present invention.
Figure 2:
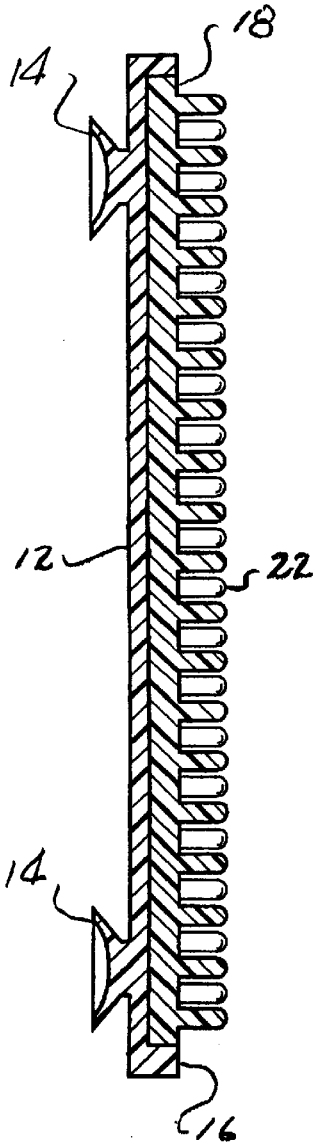
FIG. 2 is a side view in section of the device of FIG. 1.
Figure 3:
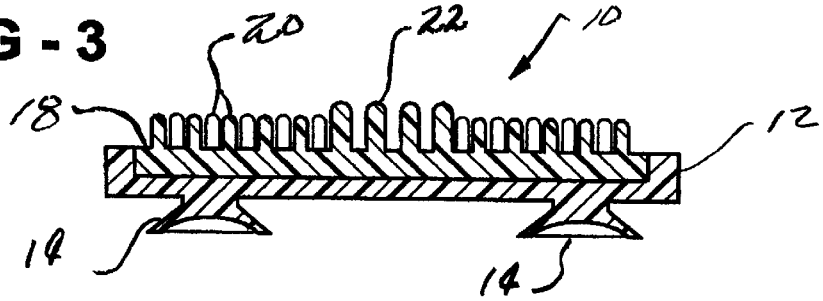
FIG. 3 is another sectional view showing a detail of the scrubbing surface.

Referring now to the drawing, there is shown an epidermal scrubbing device 10 intended for use on the epidermal external surfaces of human subjects for hygienic purposes as well as to remove dead skin and stimulate circulation. The device 10 comprises an hourglass shaped, rigid base 12 of low to medium density polyethylene, the major dimensions of which are approximately 15 to 18 inches long by 10 inches wide by approximately 1 inch deep. The base has formed integrally therewith a plurality of suction cups 14 by which the device may be securely attached to the tiled wall of a shower or to the floor of a shower or to any smooth nonporous surface as may be desired. The suction cups 14 may, alternatively, be attached by screws. The base 12 is configured to provide a peripheral rim 16 which defines a cavity into which is either bonded or insert molded and a scrubbing insert 18, the outwardly facing surface of which is characterized by a uniform, two-dimensional array of spaced soft plastic, smooth surfaced, nub-like protrusions 20 of a height of approximately ⅛ to ⅜ of an inch and a width-to-height ratio of between approximately 1:1 and 2:1. The nub-like protrusions 20 are preferably arranged in patterns from about 4 to about 16 per square inch and are preferably fabricated from a relatively soft, smooth plastic such as homopolymeric polypropylene which is an easily molded thermoplastic material having a flexural modulus of between 150 and 230 and a notched Izod impact coefficient of about 0.4 to about 1.2. The material is, therefore, relatively soft and smooth to avoid injury to the human epidermis when vigorously scrubbed therewith yet providing a comfortable and stimulating effect over a fairly wide surface area.

In the preferred embodiment, the device 10 is further provided with a vertical column running longitudinally down the center of the scrubbing surface 18 of slightly higher nub-like protrusions 22 which are between ⅜ and ½ of an inch in height and have a height-to-width ratio of about 3:2. As shown in drawing, the column alternates rows of three protrusions and four protrusions thus to provide an area which is suitable for scrubbing certain parts of the body such as the spinal area in the center of the back and/or the toe and arch areas of the feet.

In use, the device 10 is attached by way of the suction cups 14 to, for example, the wall of a shower at a height which corresponds to approximately the center of the back of the human subject using the device. Soap may be applied in various ways to the device or to the skin either bar soap or medium viscosity liquid soap being the more convenient mechanisms. Thereafter, with the back suitably wetted by the shower water, the subject maneuvers himself or herself against the device 10 to scrub the desired areas for as long as is desired.

Being all one-piece, the device 10 is easily washed or cleaned and/or disinfected from time to time. Being essentially seamless, there are no parts to inventory or replace and no cracks or seams to accumulate bacteria or grow mildew. It will be understood that the invention may be configured in various ways and in various shapes and sizes to suit the aesthetic and functional desires of the designer. For example, a device for scrubbing and massaging the feed may be created by placing a four inch wide array of the nub-like protrusions 20 between two narrower outside rows of higher protrusions 22. In this case, the base is rectangular.

What is claimed is:

1. A human epidermal scrubbing device of the type which comprises a base attachable to a surface and, essentially integral with said base, a substantially planar scrubbing area, characterized in that:

the base is rigid;

the scrubbing area comprises a seamless, two-dimentional array of closely and essentially uniformly spaced soft plastic, smooth surfaced, nub-like protrusions covering essentially the entire surface area; and the protrusions have an essentially uniform width throughout their height; wherein the array of closely spaced soft plastic, smooth surfaced, nub-like protrusions comprises protrusions of different height, protrusions of grater height being arranged in a column extending through the center of protrusions of lesser height and, wherein the protrusions of greater height have a greater width than the protrusions of lesser height.

* * * * *